US010516952B2

(12) United States Patent
Thrasher

(10) Patent No.: US 10,516,952 B2
(45) Date of Patent: Dec. 24, 2019

(54) COMBINATION AUDIO INPUT AND HEARING AID KIT

(71) Applicant: Rhonda Thrasher, New Castle, IN (US)

(72) Inventor: Rhonda Thrasher, New Castle, IN (US)

( * ) Notice: Subject to any disclaimer, the term of this patent is extended or adjusted under 35 U.S.C. 154(b) by 0 days.

(21) Appl. No.: 15/339,235

(22) Filed: Oct. 31, 2016

(65) Prior Publication Data

US 2018/0124523 A1 May 3, 2018

(51) Int. Cl.
*H04R 25/00* (2006.01)

(52) U.S. Cl.
CPC ..... *H04R 25/556* (2013.01); *H04R 2225/021* (2013.01); *H04R 2225/023* (2013.01); *H04R 2225/61* (2013.01)

(58) Field of Classification Search
CPC .... H04R 25/00; H04R 1/1016; H04R 1/1041; H04R 2225/61; H04R 2225/43; H04R 1/1033; H04R 2225/023; H04R 25/556; H04R 2225/025; H04R 2225/021; H04R 2225/0213
USPC ..... 381/322, 312, 71.6
See application file for complete search history.

(56) References Cited

U.S. PATENT DOCUMENTS

D318,670 S 7/1991 Taniguchi
6,620,094 B2 9/2003 Miller
8,009,849 B2 8/2011 Enzmann
8,306,253 B2 11/2012 Devlas et al.
8,503,708 B2 8/2013 Galster et al.
2005/0058306 A1* 3/2005 Peng ..... G06F 3/0227 381/118
2005/0271218 A1* 12/2005 Peng ..... H04S 3/004 381/74
2009/0046874 A1* 2/2009 Doman ..... H04R 25/00 381/151
2011/0019846 A1* 1/2011 Anderson ..... A61B 5/121 381/313
2012/0189149 A1* 7/2012 Finlay ..... H04R 25/00 381/328
2013/0339025 A1* 12/2013 Suhami ..... H04R 25/00 704/271
2014/0078462 A1* 3/2014 Abreu ..... G02C 3/003 351/111
2015/0350797 A1* 12/2015 Muller ..... H04R 1/1041 381/323

* cited by examiner

*Primary Examiner* — Yogeshkumar Patel

(57) ABSTRACT

A combination audio input and hearing aid kit including a hearing aid device. An audio Y cable connector has a pair of upper ports and a lower port. A first audio cable has a proximal end selectively electrically coupled to the hearing aid device and a distal end selectively electrically coupled to a first of the pair of upper ports of the audio Y cable connector. An earbud headphone is selectively electrically coupled to a second of the pair of upper ports of the audio Y cable connector. Lastly, a second audio cable has a first end selectively electrically coupled to the lower port of the audio Y cable connector and a second end selectively electrically coupled to a remote electronic device.

3 Claims, 4 Drawing Sheets

COMBINATION AUDIO INPUT AND HEARING AID KIT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of hearing aids are known in the prior art. However, what has been needed is a combination audio input and hearing aid kit including a hearing aid device. What has been further needed is an audio Y cable connector having a pair of upper ports and a lower port, a first audio cable having a proximal end selectively electrically coupled to the hearing aid device and a distal end selectively electrically coupled to a first of the pair of upper ports of the audio Y cable connector, and an earbud headphone selectively electrically coupled to a second of the pair of upper ports of the audio Y cable connector. Lastly, what has been needed is a second audio cable having a first end selectively electrically coupled to the lower port of the audio Y cable connector and a second end selectively electrically coupled to a remote electronic device. The combination audio input and hearing aid kit is thus uniquely structured to privatize hearing options for a hearing impaired person by allowing a wearer to directly connect a hearing aid device to a remote electronic device and an earbud headphone.

FIELD OF THE INVENTION

The present invention relates to hearing aids, and more particularly, to a combination audio input and hearing aid kit.

SUMMARY OF THE INVENTION

The general purpose of the present combination audio input and hearing aid kit, described subsequently in greater detail, is to provide a combination audio input and hearing aid kit which has many novel features that result in a combination audio input and hearing aid kit which is not anticipated, rendered obvious, suggested, or even implied by prior art, either alone or in combination thereof.

To accomplish this, the present combination audio input and hearing aid kit includes a hearing aid device having an ear case, a volume dial disposed on the ear case, a battery housing disposed within the ear case, a battery disposed within the battery housing, a battery port disposed on the ear case, an activation control disposed on the ear case, a central processing unit disposed within the ear case, a microphone disposed on the ear case, and a speaker disposed on the ear case.

The combination audio input and hearing aid kit further includes an audio Y cable connector having a pair of upper ports and a lower port. A first audio cable has a proximal end selectively electrically coupled to the hearing aid device and a distal end selectively electrically coupled to a first of the pair of upper ports of the audio Y cable connector. An earbud headphone is selectively electrically coupled to a second of the pair of upper ports of the audio Y cable connector. Lastly, a second audio cable has a first end selectively electrically coupled to the lower port of the audio Y cable connector and a second end selectively electrically coupled to a remote electronic device. The remote electronic device can include, but not be limited to, a cellular phone and a tablet.

The hearing aid device is selectively wearable in a first of a pair of ears of a wearer, and the earbud headphone is selectively wearable in a second of the pair of ears of the wearer. The hearing aid device is optionally one of a behind-the-ear hearing aid and, alternately, an in-the-canal hearing aid. It is envisioned that the earbud headphone can optionally be a second hearing aid device if a wearer must connect to the remote electronic device using a pair of hearing aid devices rather than just a single device.

Thus has been broadly outlined the more important features of the present combination audio input and hearing aid kit so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
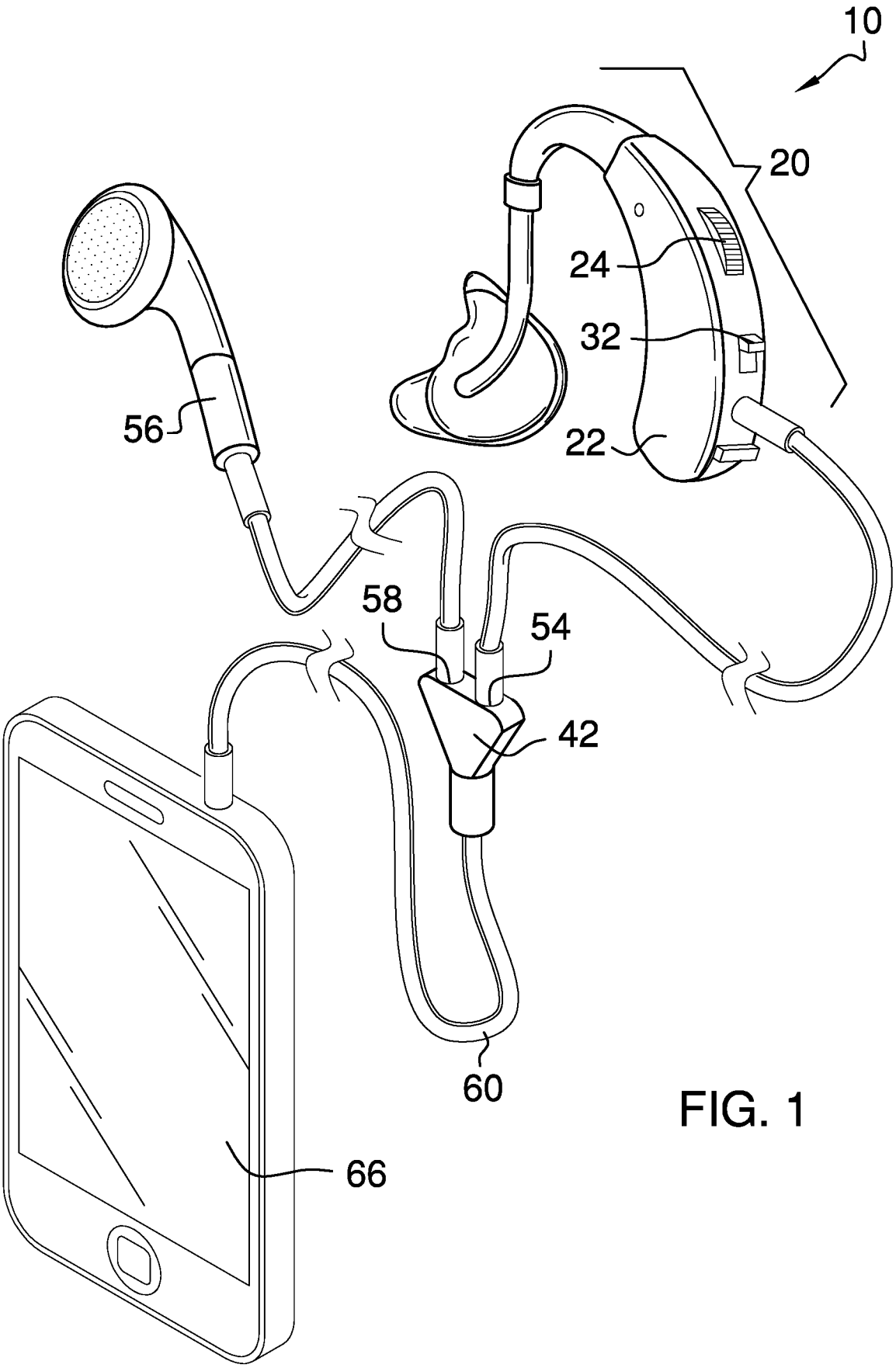
FIG. 1 is a front isometric view showing a behind-the-ear hearing aid.
Figure 2:
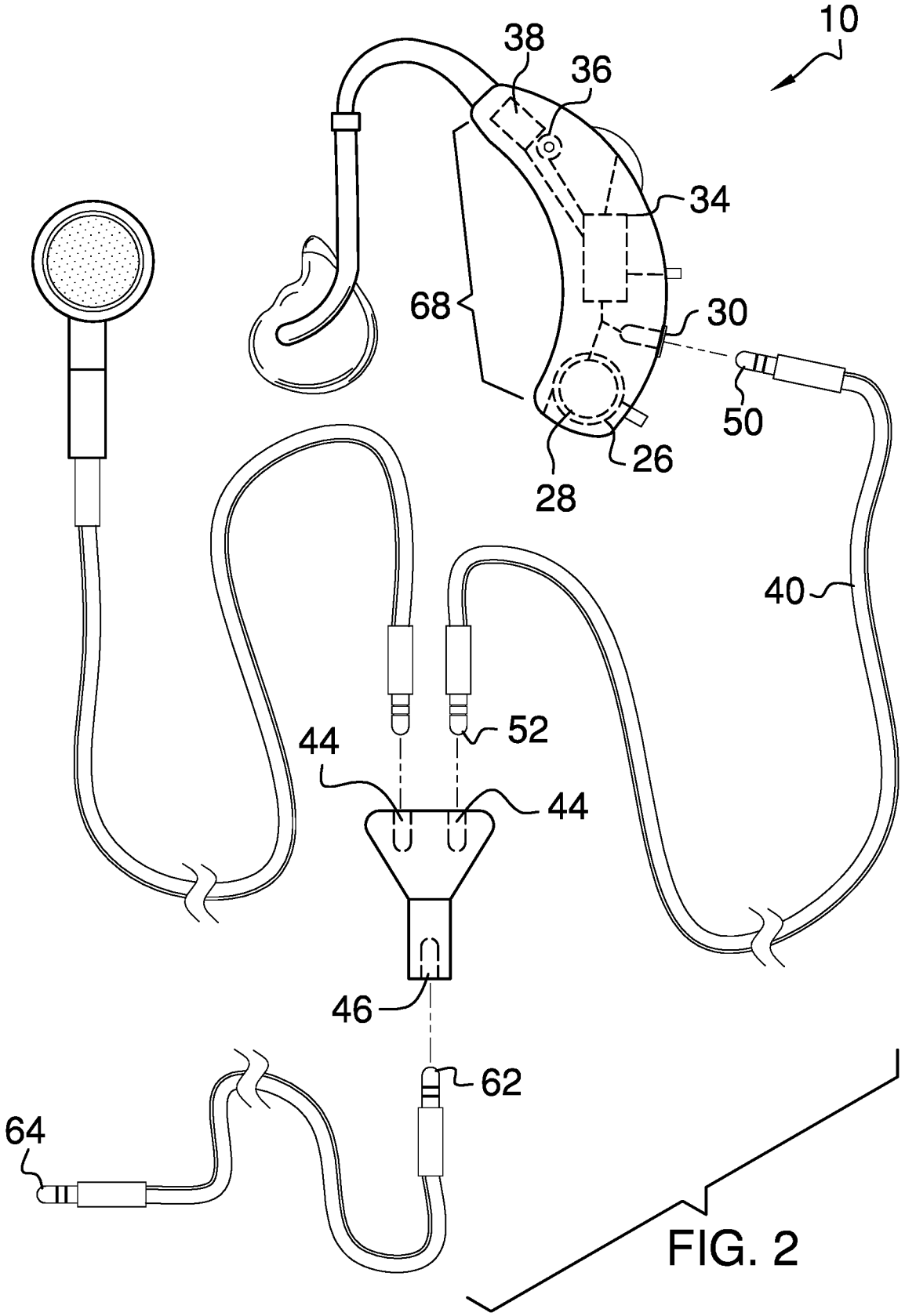
FIG. 2 is an exploded view.
Figure 3:
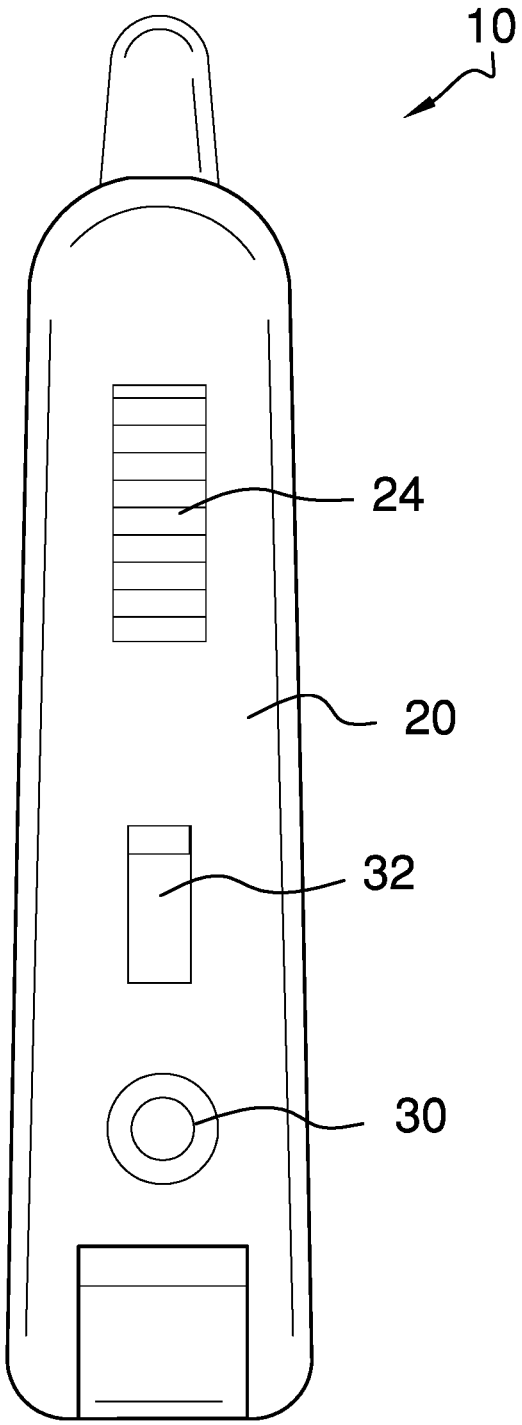
FIG. 3 is a side elevation view.
Figure 4:
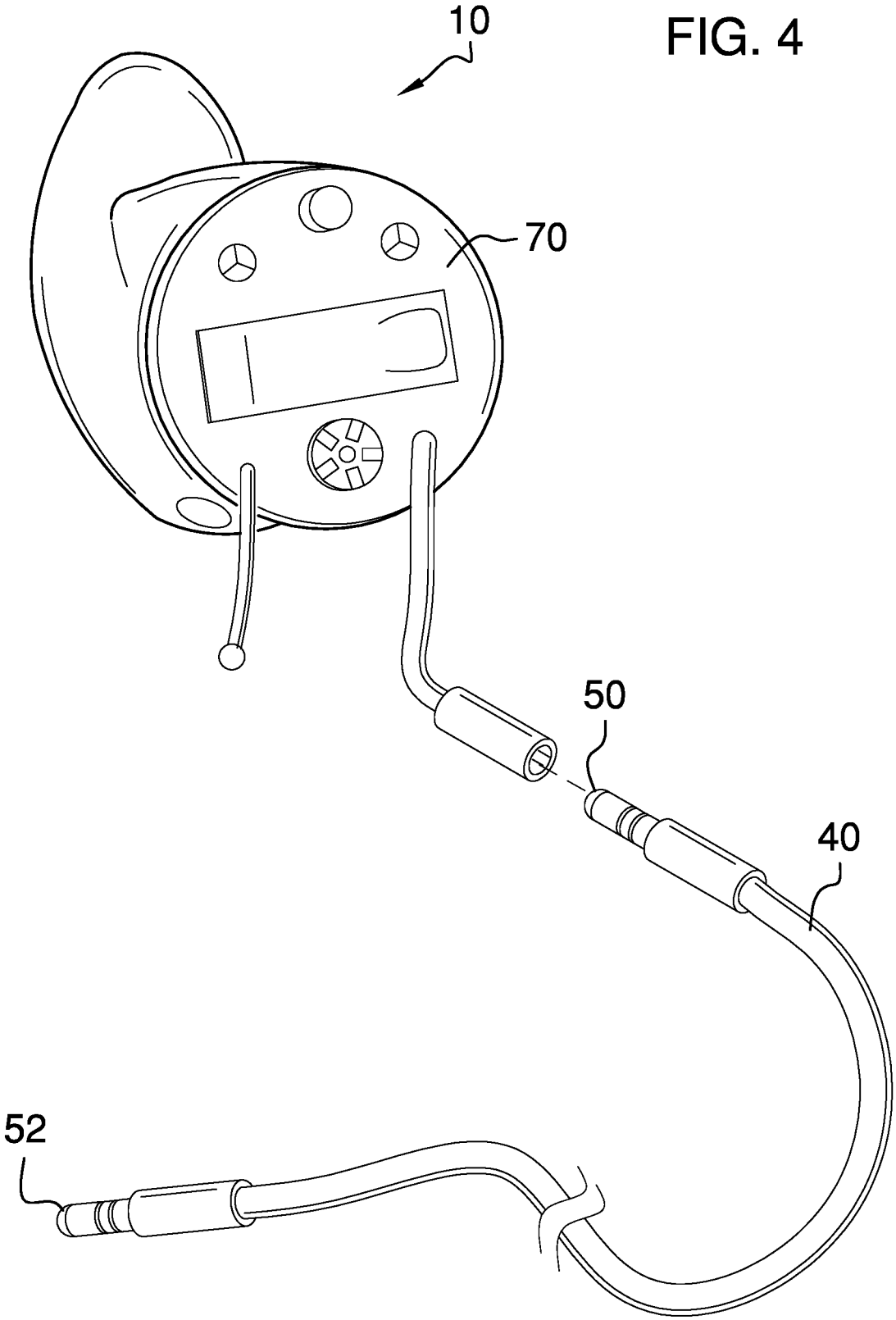
FIG. 4 is a front isometric view showing an in-the-canal hearing aid.

With reference now to the drawings, and in particular FIGS. 1 through 4 thereof, an example of the instant combination audio input and hearing aid kit employing the principles and concepts of the present combination audio input and hearing aid kit and generally designated by the reference number 10 will be described.

Referring to FIGS. 1 through 4 the present combination audio input and hearing aid kit 10 is illustrated. The combination audio input and hearing aid kit 10 includes a hearing aid device 20 having an ear case 22, a volume dial 24 disposed on the ear case 22, a battery housing 26 disposed within the ear case 22, a battery 28 disposed within the battery housing 26, a battery port 30 disposed on the ear case 22, an activation control 32 disposed on the ear case 22, a central processing unit 34 disposed within the ear case 22, a microphone 36 disposed on the ear case 22, and a speaker 38 disposed on the ear case 22.

The combination audio input and hearing aid kit 10 further includes an audio Y cable connector 42 having a pair of upper ports 44 and a lower port 46. A first audio cable 40 has a proximal end 50 selectively electrically coupled to the hearing aid device 10 and a distal end 52 selectively electrically coupled to a first 54 of the pair of upper ports 44 of the audio Y cable connector 42. An earbud headphone 56 is selectively electrically coupled to a second 58 of the pair of upper ports 44 of the audio Y cable connector 42. Lastly, a second audio cable 60 has a first end 62 selectively electrically coupled to the lower port 46 of the audio Y cable connector 42 and a second end 64 selectively electrically coupled to a remote electronic device 66. The hearing aid device 20 is optionally one of a behind-the-ear hearing aid 68 and, alternately, an in-the-canal hearing aid 70.

What is claimed is:

1. A combination audio input and hearing aid kit comprising:

a hearing aid device having an ear case, a volume dial disposed on the ear case, a battery housing disposed within the ear case, a battery disposed within the battery housing, a battery port disposed on the ear case, an activation control disposed on the ear case, a central processing unit disposed within the ear case, a microphone disposed on the ear case, and a speaker disposed on the ear case;

an audio Y cable connector having a pair of upper ports and a lower port;

a first audio cable having a proximal end selectively electrically coupled to the hearing aid device and a distal end selectively electrically coupled to a first of the pair of upper ports of the audio Y cable connector;

an earbud headphone selectively electrically coupled to a second of the pair of upper ports of the audio Y cable connector; and a second audio cable having a first end selectively electrically coupled to the lower port of the audio Y cable connector and a second end selectively electrically coupled to a remote electronic device;

wherein the hearing aid device is selectively wearable in a first of a pair of ears of a wearer;

wherein the earbud headphone is selectively wearable in a second of the pair of ears of the wearer.

2. The combination audio input and hearing aid kit of claim 1 wherein the hearing aid device is a behind-the-ear hearing aid.

3. The combination audio input and hearing aid kit of claim 1 wherein the hearing aid device is an in-the-canal hearing aid.

* * * * *